US011091881B2

(12) United States Patent
Yu

(10) Patent No.: US 11,091,881 B2
(45) Date of Patent: Aug. 17, 2021

(54) METHOD AND APPARATUS FOR WALLPAPER ALIGNMENT

(71) Applicant: Yang Yu, Temple City, CA (US)

(72) Inventor: Yang Yu, Temple City, CA (US)

( * ) Notice: Subject to any disclaimer, the term of this patent is extended or adjusted under 35 U.S.C. 154(b) by 322 days.

(21) Appl. No.: 16/367,089

(22) Filed: Mar. 27, 2019

(65) Prior Publication Data

US 2020/0308772 A1 Oct. 1, 2020

(51) Int. Cl.

| | |
|---|---|
| ***D21H 27/20*** | (2006.01) |
| *B44C 7/06* | (2006.01) |
| *B44C 7/04* | (2006.01) |

(52) U.S. Cl.

CPC ..... *D21H 27/20* (2013.01); *B44C 7/04* (2013.01); *B44C 7/06* (2013.01)

(58) Field of Classification Search

CPC ..... D21H 27/20

See application file for complete search history.

*Primary Examiner* — Ian A Rummel

(74) *Attorney, Agent, or Firm* — Che-Yang Chen; Law Office of Michael Chen

(57) ABSTRACT

In one aspect, a wallpaper alignment apparatus may include a first alignment unit and a second alignment unit. In one embodiment, each of the first and second alignment units is detachably disposed and aligned with the edge of the wallpaper through an adhesive. The first alignment unit has a first elongated main body and a plurality of protrusions extending from the first elongated main body. The second alignment unit has a second elongated main body and a plurality of recesses formed on the second elongated main body to receive corresponding protrusions on the first alignment unit to further align the wallpapers.

3 Claims, 3 Drawing Sheets

METHOD AND APPARATUS FOR WALLPAPER ALIGNMENT

FIELD OF THE INVENTION

The present invention relates to a method and apparatus for applying wallpapers, and more particularly to a method and apparatus for aligning wallpapers during application process.

BACKGROUND OF THE INVENTION

Several wallpaper applicators have been proposed for simplifying the wallpaper application process. Such devices are more particularly, described in U.S. Pat. Nos. 4,210,485 and 4,806,184. These devices are generally bulky and difficult to manipulate. More importantly, the prior art applicators have two serious drawbacks.

First, the devices are designed to apply tension to the wallpaper as it is being applied to the wall. As the wallpaper dries, the wallpaper relaxes and contracts. Adjacent sheets of wallpaper usually contract at different rates and at different locations. When using patterned wallpaper, where the patterns of adjacent sheets must match up exactly, this becomes particularly acute.

Secondly, the prior art applicators do not assist the user in initially positioning the strip of wallpaper so that it aligns properly with respect to the ceiling and with respect to adjacent strips of wallpaper. Therefore, there remains a need for a new and improved method and apparatus to overcome the problems stated above.

SUMMARY OF THE INVENTION

In one aspect, a wallpaper alignment apparatus may include a first alignment unit and a second alignment unit. In one embodiment, each of the first and second alignment units is disposed at an edge of a wallpaper. More specifically, each of the first and second alignment units is detachably disposed and aligned with the edge of the wallpaper through an adhesive.

In one embodiment, the first alignment unit has a first elongated main body and a plurality of protrusions, wherein the elongated main body has two parallel elongated edges, one of which is aligned with an edge of a first wallpaper; and the protrusions are extending from the elongated edge that is aligned with the edge of the first wallpaper.

The second alignment unit has a second elongated main body and a plurality of recesses, wherein the second elongated main body has two parallel elongated edges, one of which is aligned with an edge of a second wallpaper; and the recesses are formed on the second elongated main body to receive corresponding protrusions on the first alignment unit.

When in use, the first alignment unit along with the first wallpaper is moving towards the second alignment unit with the second wallpaper, and each protrusion on the first alignment unit engages with corresponding recess on the second alignment unit, so the first wallpaper and the second wallpaper can be aligned accordingly. Once the first and second wallpapers are secured on a surface (e.g. with adhesive on the backside), the first and second alignment units can be removed from the top surface of the wallpapers.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

Figure 1:
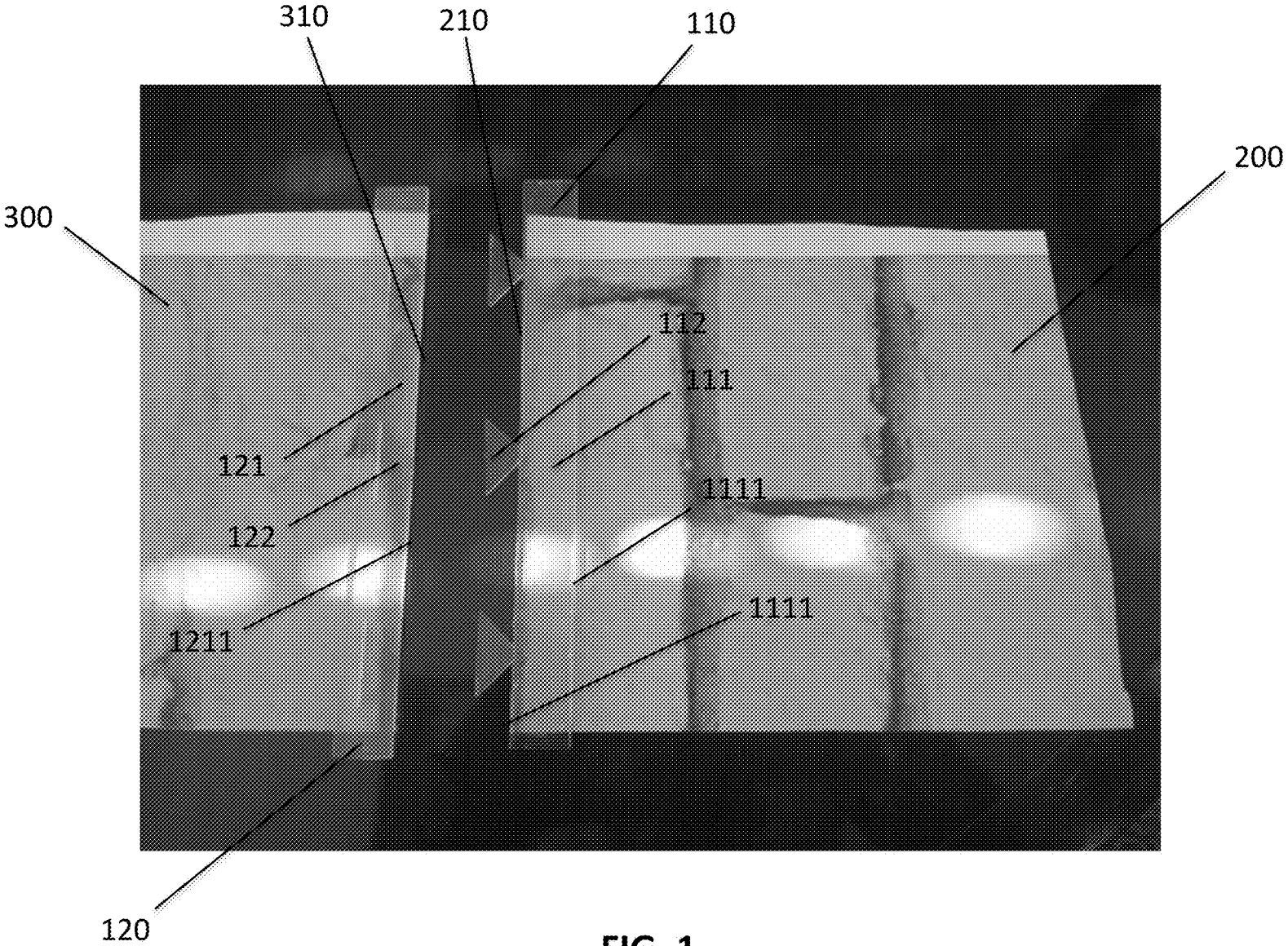
FIG. 1 is a schematic view of the method and apparatus for wallpaper alignment in the present invention when the first and second alignments are not engaged.

In one aspect, as shown in FIG. 1, a wallpaper alignment apparatus may include a first alignment unit 110 and a second alignment unit 120. In one embodiment, each of the first and second alignment units (110, 120) is disposed at an edge of a wallpaper. More specifically, each of the first and second alignment units (110, 120) is detachably disposed and aligned with the edge of the wallpaper through an adhesive.

Still referring to FIG. 1, in one embodiment, the first alignment unit 110 has a first elongated main body 111 and a plurality of protrusions 112, wherein the first elongated main body 111 has two parallel elongated edges 1111, one of which is aligned with an edge 210 of a first wallpaper 200; and the protrusions 112 are extending from the elongated edge 1111 that is aligned with the edge 210 of the first wallpaper 200.

The second alignment unit 120 has a second elongated main body 121 and a plurality of recesses 122, wherein the second elongated main body 121 has two parallel elongated edges 1211, one of which is aligned with an edge 310 of a second wallpaper 300; and the recesses 122 are formed on the second elongated main body 121 to receive corresponding protrusions 112 on the first alignment unit 110 to align the first and second wallpapers (200, 300). In one embodiment, the first and second alignment units can be made by elastic materials.

Figure 2:
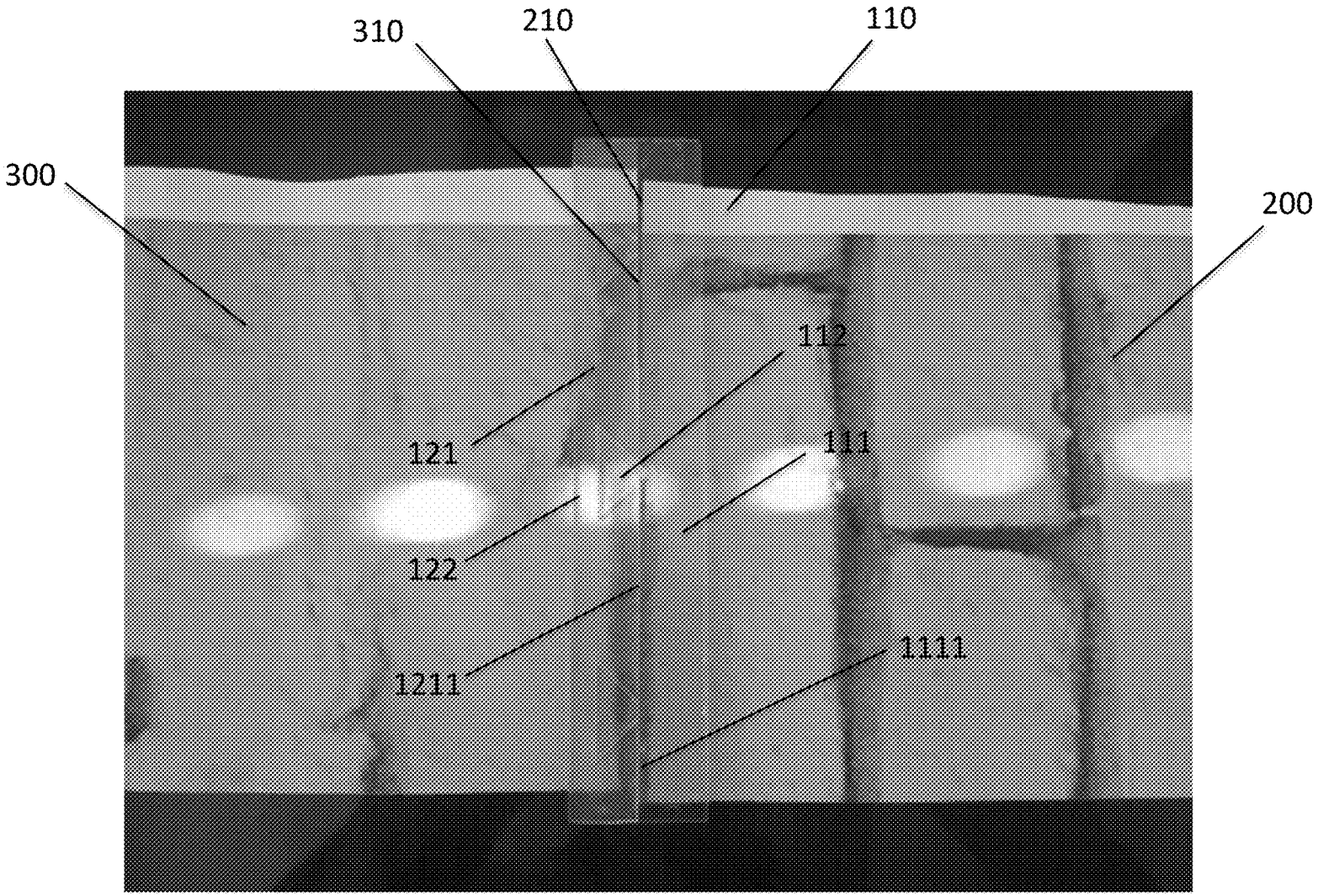
FIG. 2 illustrates a schematic view of the method and apparatus for wallpaper alignment in the present invention when the first and second alignments are engaged.
Figure 3:
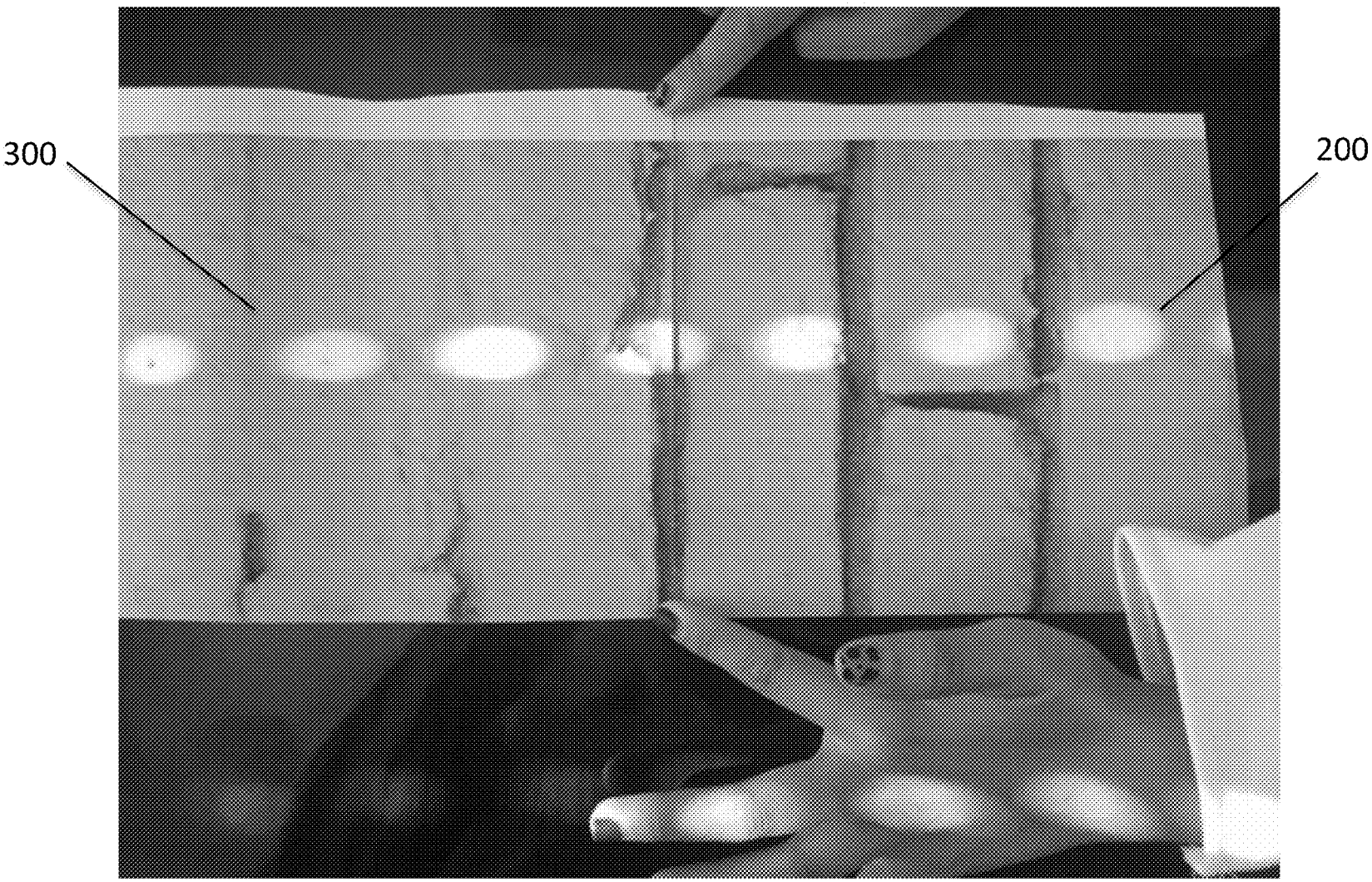
FIG. 3 illustrates a schematic view of the method and apparatus for wallpaper alignment in the present invention when the wallpapers are aligned and the first and second alignment units are removed.

When in use, the first alignment unit 110 along with the first wallpaper 200 is moving towards the second alignment unit 120 with the second wallpaper 300, and each protrusion 112 on the first alignment unit 110 engages with corresponding recess 122 on the second alignment unit 120, so the first wallpaper 200 and the second wallpaper 300 can be aligned accordingly as shown in FIG. 2. Once the first and second wallpapers are secured on a surface (e.g. with adhesive on the backside), the first and second alignment units (110, 120) can be removed from the top surface of the wallpapers as shown in FIG. 3.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A wallpaper alignment apparatus comprising:

a first wallpaper;

a second wallpaper;

a first alignment unit having a first elongated main body and a plurality of protrusions; and a second alignment unit having a second elongated main body and a plurality of recesses, wherein first the elongated main body has two first parallel elongated edges, one of which is aligned with an edge of the first wallpaper; and the protrusions are extending from the first elongated edge that is aligned with the edge of the first wallpaper, and wherein the second elongated main body has two second parallel elongated edges, one of which is aligned with an edge of the second wallpaper; and the recesses are formed on the second elongated main body to receive corresponding protrusions on the first alignment unit to align the first and second wallpapers.

2. The wallpaper alignment apparatus of claim 1, wherein each of the first and second alignment units is detachably disposed and aligned with the edge of the wallpaper through an adhesive.

3. The wallpaper alignment apparatus of claim 1, wherein the first and second alignment units are made from elastic materials.

* * * * *